US010866551B2

(12) United States Patent
Nakajima

(10) Patent No.: US 10,866,551 B2
(45) Date of Patent: Dec. 15, 2020

(54) FIXING DEVICE IN WHICH FIXING BELT DOES NOT CONTACT WITH SLIT OF BELT GUIDE AND IMAGE FORMING APPARATUS

(71) Applicant: KYOCERA Document Solutions Inc., Osaka (JP)

(72) Inventor: Eiji Nakajima, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/595,687

(22) Filed: Oct. 8, 2019

(65) Prior Publication Data

US 2020/0125018 A1 Apr. 23, 2020

(30) Foreign Application Priority Data

Oct. 19, 2018 (JP) ..... 2018-197916

(51) Int. Cl.
*G03G 15/20* (2006.01)

(52) U.S. Cl.
CPC ..... *G03G 15/2057* (2013.01); *G03G 15/2064* (2013.01); *G03G 2215/2035* (2013.01)

(58) Field of Classification Search
CPC ..... G03G 15/2053; G03G 15/2057; G03G 15/2017; G03G 2215/2035
See application file for complete search history.

(56) References Cited

U.S. PATENT DOCUMENTS 8,126,384 B2 * 2/2012 Baba ..... G03G 15/2053 399/329
9,291,965 B2 * 3/2016 Naito ..... G03G 15/2053
2011/0135358 A1 * 6/2011 Kikuchi ..... G03G 15/2064 399/329

FOREIGN PATENT DOCUMENTS

JP 2016212214 A 12/2016

* cited by examiner

*Primary Examiner* — Arlene Heredia
(74) *Attorney, Agent, or Firm* — Studebaker & Brackett PC

(57) ABSTRACT

A fixing device includes a flexible endless fixing belt, a heating part, and a belt guide. The heating part induction-heats the fixing belt from outside. The belt guide supports the fixing belt so that the fixing belt faces to the heating part. The belt guide is made of temperature sensitive magnetic material with magnetic characteristics reversibly changing from ferromagnetism to paramagnetism when predetermined temperature is reached, and includes a plurality of slits arranged in a width direction orthogonal to a circumferential direction of the fixing belt and formed along the circumferential direction. At a side of an inner circumference face of the fixing belt, a protecting part is provided so as to prevent the inner circumference face of the fixing belt from coming into direct contact with portions on the periphery of the plurality of slits.

6 Claims, 5 Drawing Sheets

FIXING DEVICE IN WHICH FIXING BELT DOES NOT CONTACT WITH SLIT OF BELT GUIDE AND IMAGE FORMING APPARATUS

INCORPORATION BY REFERENCE

This application is based on and claims the benefit of priority from Japanese Patent application No. 2018-197916 filed on Oct. 19, 2018, the entire contents of which are incorporated herein by reference.

BACKGROUND

The present disclosure relates to a fixing device fixing a toner image on a sheet and an image forming apparatus including this fixing device.

In order to respond to requests of power saving or shortening of warm-up time in recent years, lowering of heat capacity of a fixing device is progressing. As concrete structure for lowering of heat capacity, there is a case of using a flexible fixing belt heated with electromagnetic induction by an IH heater. Because electromagnetic induction heating has high heat generation efficiency and high temperature raising rate, electromagnetic induction heating has advantage that warm-up time can be shortened. In order to achieve this advantage, the fixing belt is made of material having low heat capacity. On the other hand, electromagnetic induction heating has disadvantages that heat uniformity is coarse and excessive temperature rise of a non-sheet passing area is increased.

Because the fixing belt is made of flexible material and has low shape maintainability, the fixing belt is supported by a belt guide. The belt guide is arranged in a hollow part of the fixing belt and comes into contact with an inner circumferential face of the fixing belt to make the fixing belt face to the IH heater. In order to restrain excessive temperature rise of the non-sheet passing area, the belt guide may be made of temperature sensitive magnetic material (magnetic shunt alloy). The temperature sensitive magnetic material is material with magnetic characteristics changing from ferromagnetism to paramagnetism when predetermined temperature is reached.

In a case of electromagnetic induction heating, eddy current is caused when a magnetic flux generated by the IH heater passes through a heat generating layer of the fixing belt, and the heat generating layer generates heat by its own resistance. Because a thickness of the heat generating layer is very thin (e.g. approximately a few μm to 50 μm), the magnetic flux may penetrate through the heat generating layer. The magnetic flux after penetrating reaches the belt guide, and the belt guide also generates heat. In such a case, when temperature of the non-sheet passing area is excessively risen to reach the predetermined temperature, magnetic characteristics of the non-sheet passing area changes from ferromagnetism to paramagnetism, the magnetic flux after penetrating passes through the belt guide, and heat generating of the non-sheet passing area is restrained. However, if the temperature of the non-sheet passing area is excessively risen, heat of the non-sheet passing area may be transmitted to a sheet passing area, and temperature of the sheet passing area may be risen to the predetermined temperature. Subsequently, magnetic characteristics of the sheet passing area changes from ferromagnetism to paramagnetism, heat generating of the sheet passing area is restrained, and rising of temperature of the fixing belt is disturbed. Therefore, it is preferable to restrain heat generating of the belt guide.

Accordingly, in a conventional fixing device, in temperature sensitive magnetic material (a belt guide), a plurality of continuous cutout parts cut-out continuously over a moving direction of a fixing member (a fixing belt) are formed. In a case where the plurality of continuous cutout parts are not formed, eddy current passing through the temperature sensitive magnetic material is generated over the entire in a longitudinal direction of the temperature sensitive magnetic material. On the other hand, in a case where the plurality of continuous cutout parts are formed, eddy current is generated between adjacent cutout parts. That is, because heat transmission in the longitudinal direction is interrupted, heat transmission from the non-sheet passing area to the sheet passing area is restrained. Therefore, rising of the temperature of the sheet passing area is restrained, and the temperature of the fixing belt is easily risen.

Because a flexible fixing member as a conventional fixing device has low rigidity in a circumferential direction and is rotated by following a pressuring roller, shape maintainability is unstable. Therefore, the fixing member is rotated while partly coming into contact with the temperature sensitive magnetic material and being guided by it.

Thus, if the inner circumferential face of the fixing member comes into contact with the temperature sensitive magnetic material, it is feared that a base material layer at the inside of the fixing member is damaged. If the damage is progressed, it is feared that the fixing member is broken.

SUMMARY

In accordance with an embodiment of the present disclosure, a fixing device includes a flexible endless fixing belt, a heating part, and a belt guide. The heating part induction-heats the fixing belt from outside. The belt guide supports the fixing belt so that the fixing belt faces to the heating part. The belt guide is made of temperature sensitive magnetic material with magnetic characteristics reversibly changing from ferromagnetism to paramagnetism when predetermined temperature is reached, and includes a plurality of slits arranged in a width direction orthogonal to a circumferential direction of the fixing belt and formed along the circumferential direction. At a side of an inner circumference face of the fixing belt, a protecting part is provided so as to prevent the inner circumference face of the fixing belt from coming into direct contact with portions on the periphery of the plurality of slits.

In accordance with an embodiment of the present disclosure, an image forming apparatus includes an image forming part forming a toner image on a sheet, and the above-described fixing device fixing the toner image on the sheet.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, an image forming apparatus and a fixing device according to embodiments of the present disclosure will be described with reference to the drawings.

Figure 1:
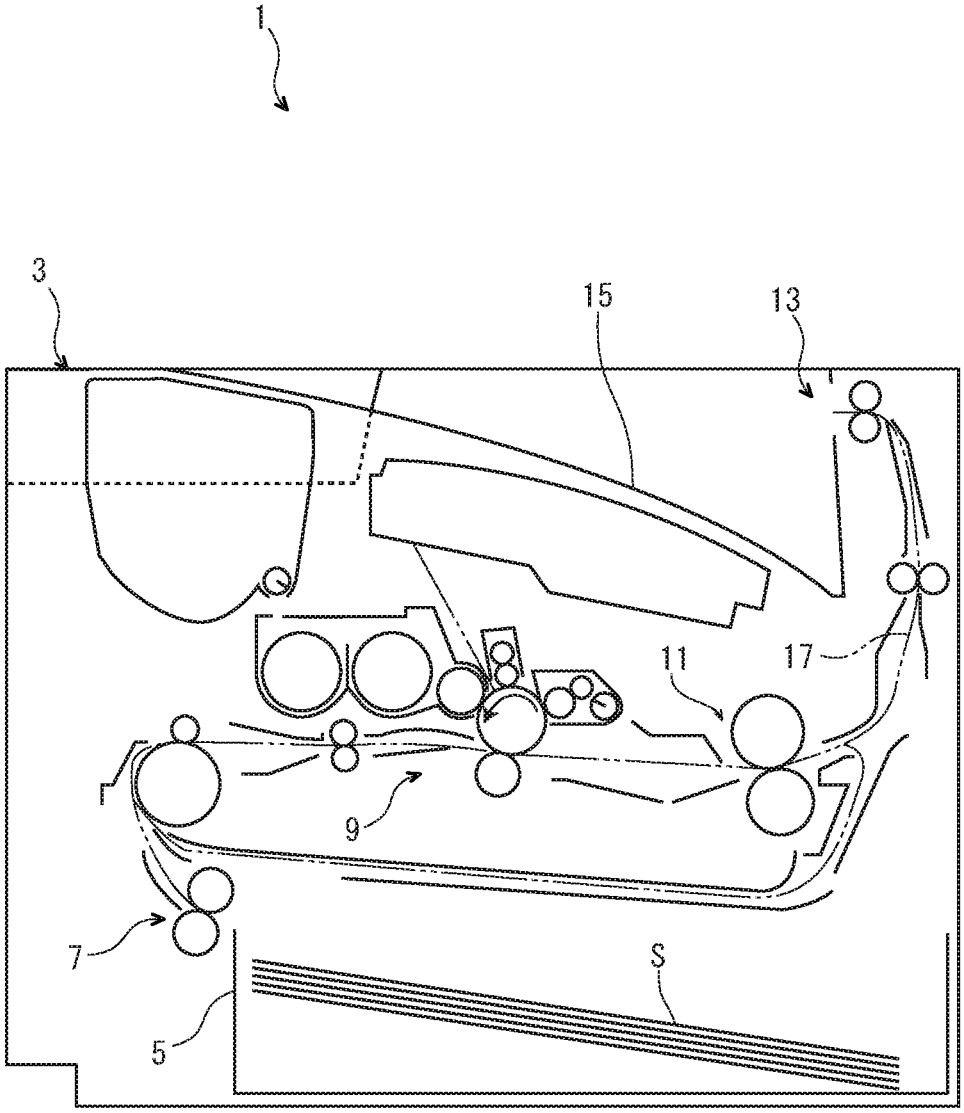
FIG. 1 is a sectional view schematically showing an internal structure an image forming apparatus according to an embodiment of the present disclosure.

First, with reference to FIG. 1, the entire structure of an image forming apparatus 1 (e.g. a printer) will be described. FIG. 1 is a sectional view schematically showing an internal structure the image forming apparatus 1. It will be described so that the front side of the image forming apparatus 1 is positioned at a near side on a paper sheet of FIG. 1.

An apparatus body 3 of the image forming apparatus 1 is provided with a sheet feeding cartridge 5 in which sheets S are stored, a sheet feeding device 7 feeding the sheet S from the sheet feeding cartridge 5, an image forming part 9 forming a toner image on the sheet S, a fixing device 11 fixing the toner image on the sheet S, a sheet ejecting device 13 ejecting the sheet S, and an ejected sheet tray 15 on which the ejected sheet S is placed. Further, in the apparatus body 3, a conveying path 17 for the sheet S conveyed from the sheet feeding device 7 to the sheet ejecting device 13 via the image forming part 9 and the fixing device 11 is arranged.

The sheet S fed from the sheet feeding cartridge 5 by the sheet feeding device 7 is conveyed along the conveying path 17 to the image forming part 9, and then, the toner image is formed on the sheet S in the image forming part 9. The sheet S is conveyed along the conveying path 17 to the fixing device 11, and then, the toner image is fixed on the sheet S in the fixing device 11. The sheet S having the fixed toner image is ejected from the sheet ejecting device 13 and is placed on the ejected sheet tray 15.

Figure 2:
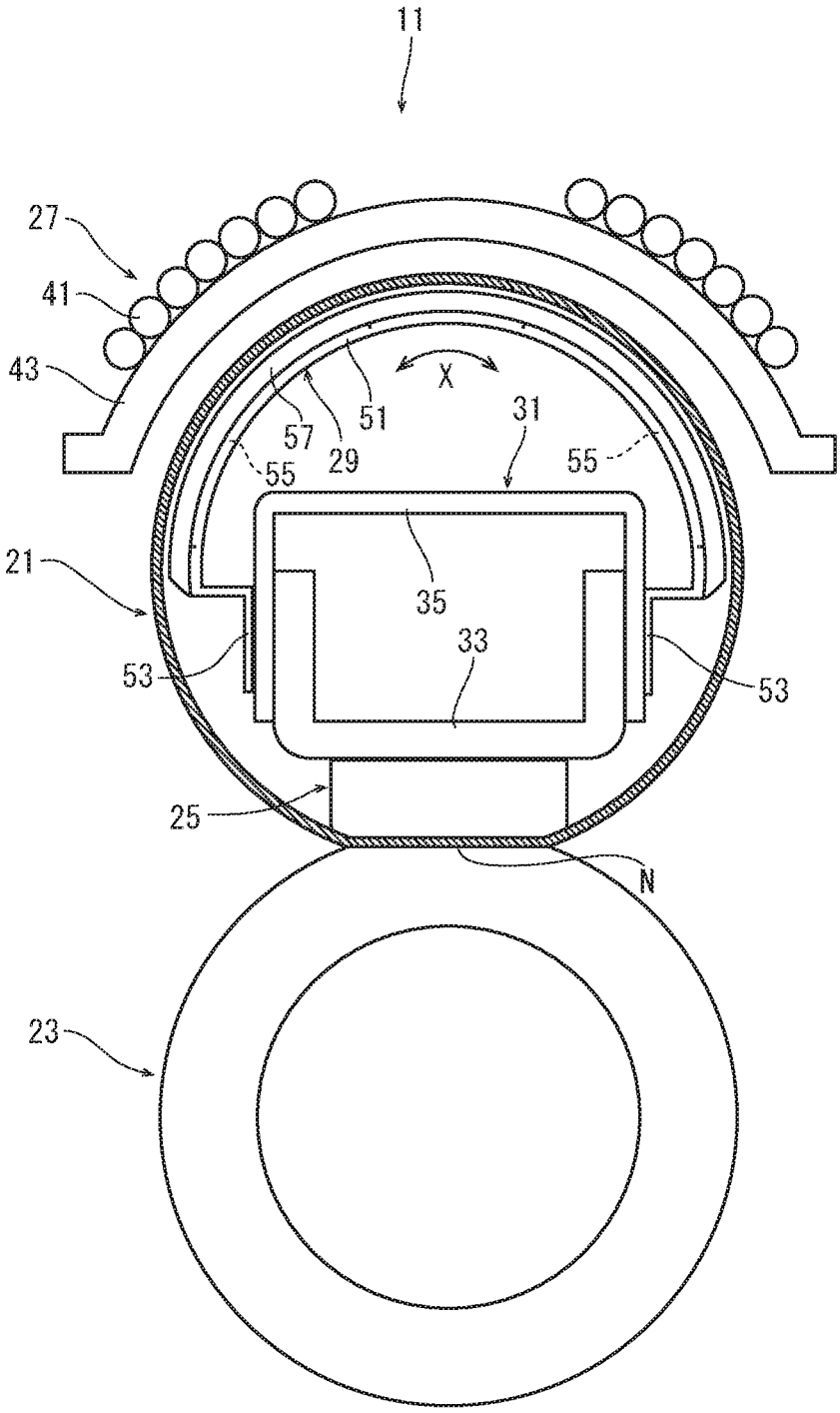
FIG. 2 is a sectional view schematically showing a fixing device according to a first embodiment of the present disclosure.

Next, the fixing device 11 will be described with reference to FIG. 2. FIG. 2 is a sectional view schematically showing the fixing device 11.

The fixing device 11 includes a flexible endless fixing belt 21, a pressuring roller 23, a pressing pad 25, an IH (Induction Heating) heater 27, and a belt guide 29. The pressuring roller 23 is a pressuring member forming a pressuring area N between the fixing belt 21 and the pressuring roller 23. The pressing pad 25 is a pressing member pressing the fixing belt 21 to the pressuring roller 23 in the pressuring area N. The IH heater 27 is a heating part induction-heating the fixing belt 21. The belt guide 29 comes into contact with or comes close to an inner circumferential face of the fixing belt 21 to support the fixing belt 21 so that the fixing belt 21 faces to the IH heater 27.

The fixing belt 21 is an endless belt having a predetermined inner diameter and having a width longer than a sheet passing area on which the sheet S is passed. The inner diameter is, as one example, 20 mm to 50 mm. The fixing belt 21 is made of flexible material and has a base material layer, an elastic layer provided on an outer circumferential face of the base material layer, and a release layer provided on an outer circumferential face of the elastic layer. The base material layer is made of magnetic metal, such as Ni (nickel). A thickness of the base material layer is, as one example, 30 μm. The elastic layer is made of silicon rubber or the like. A thickness of the elastic layer is, as one example, 200 μm. The release layer is made of PFA (Perfluoro alkoxy alkane) tube or the like. A thickness of the release layer is, as one example, 30 μm. On an inner circumferential face of the base material layer, a sliding layer may be formed. The sliding layer is made of polyimideamide, PTFE (polytetrafluoroethylene) or the like.

The fixing belt 21 is rotatably supported by a supporting mechanism (not shown) at its both ends.

The pressuring roller 23 has a core metal, an elastic layer provided on an outer circumferential face of the core metal, and a release layer provided on an outer circumferential face of the elastic layer. The core metal is made of aluminum or the like. The elastic layer is made of silicon rubber or the like. The release layer is made of PFA tube or the like. One end of the core metal is connected to a driving source (not shown), and the pressuring roller 23 is rotatable in a clockwise direction on a paper sheet of FIG. 2 by the driving source (not shown). The pressuring roller 23 is arranged at a lower side of the fixing belt 21.

The pressing pad 25 is supported by a supporting member 31 provided in a hollow part of the fixing belt 21. The supporting member 31 is a hollow rectangular tube member. The supporting member 31 is formed so that a first member 33 and a second member 35 having respective openings at one side face and having respective U-shaped sections are fixed in a state that the openings faces to each other. The first member 33 and the second member 35 are, as one example, made of non-magnetic material, such as aluminum.

The pressing pad 25 is a roughly rectangular parallelepiped member having a width equal to the width of the fixing belt 21, and is made of, for example, a liquid crystal polymer. The pressing pad 25 is arranged so as to face to the pressuring roller 23, and is fixed to a lower face of the supporting member 31. The pressing pad 25 comes into contact with the inner circumferential face of the fixing belt 21 to press the fixing belt 21 to the pressuring roller 23. Thereby, the pressuring area N is formed between the fixing belt 21 and the pressuring roller 23.

The IH heater 27 includes a coil part 41 and a coil bobbin 42 holding the coil part 41 in a winding shape. The IH heater 27 is arranged at an opposite side to the pressuring roller 23 with respect to (across) the fixing belt 21, and is supported so as to cover a roughly half (an upper half) of the outer circumferential face of the fixing belt 21. When a high frequency AC voltage is applied into the coil part 41, a magnetic flux is generated. When this magnetic flux is passed through the base material layer of the fixing belt 21, eddy current is caused in the base material layer to generate heat in the base material layer, and thereby, the fixing belt 21 is heated.

Figure 3:
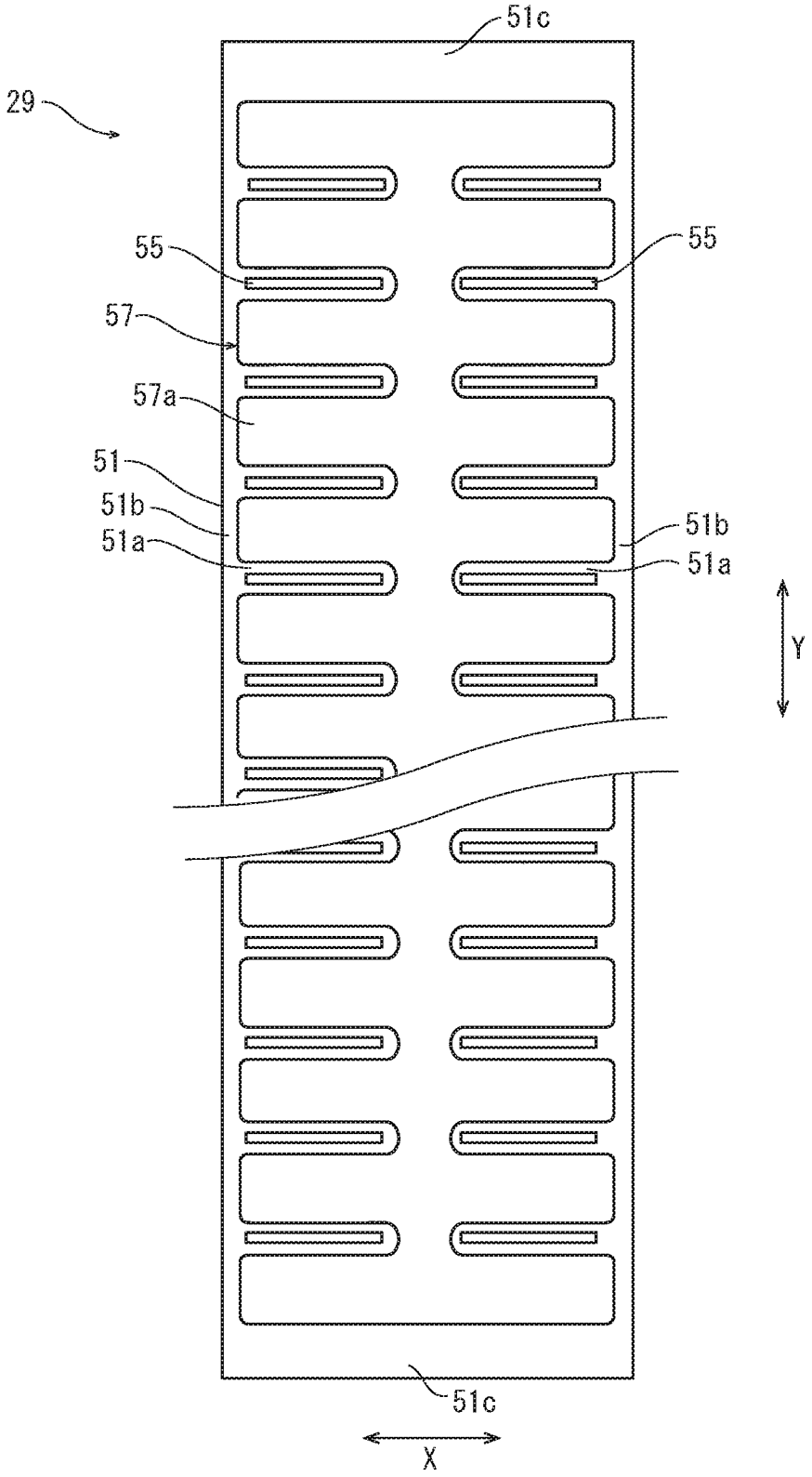
FIG. 3 is a plane view showing a belt guide, as viewed from an upper side, in the fixing device according to the first embodiment of the present disclosure.
Figure 4:
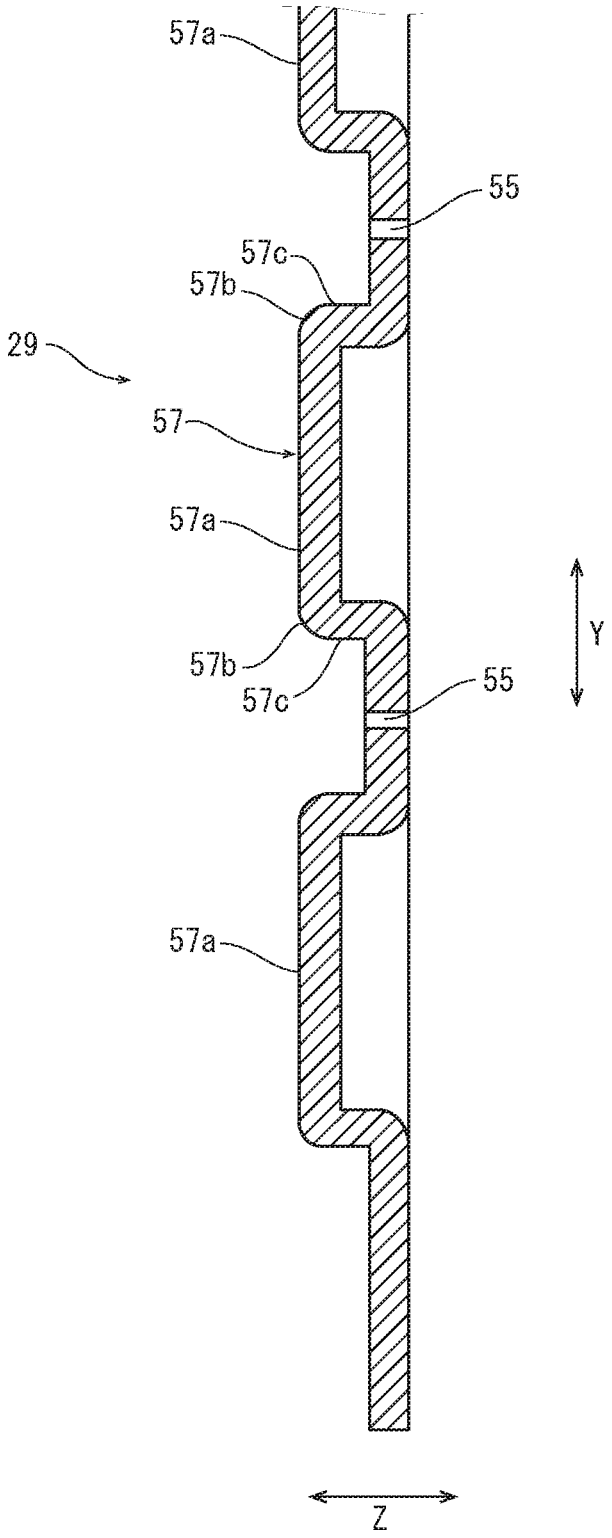
FIG. 4 is a sectional view showing the belt guide of the fixing device according to a first embodiment of the present disclosure.

Next, the belt guide 29 according to a first embodiment will be described with reference to FIGS. 2, 3 and 4. FIG. 3 is a plane view showing the belt guide 29, as viewed from an upper side, and FIG. 4 is a sectional view showing the belt guide 29.

The belt guide 29 is a member having a spring property, and includes a body part 51 coming into contact with or coming close to the inner circumferential face of the fixing belt 21, and supporting end parts 53 provided at both ends of the body part 51 in a circumferential direction X of the fixing belt 21. The supporting end parts 53 are bent from both ends of the body part 51 to inward sides in a radial direction of the fixing belt 21, and further, bent at right angles toward an opposite side to the body part 51.

The belt guide 29 is made of temperature sensitive magnetic material (magnetic shunt alloy). The temperature sensitive magnetic material is material with magnetic characteristics reversibly changing from ferromagnetism to paramagnetism when predetermined temperature (Curie temperature) is reached. The temperature sensitive magnetic material is, for example, Fe—Ni alloy, and Curie temperature is set to more than fixable temperature and less than heat resistant temperature of the material of the fixing belt 21, as one example, set to 200 degree centigrade.

As shown in FIG. 3, in the body part 51, a plurality of slits 55 along the circumferential direction X are formed. The plurality of slits 55 are arranged at regular intervals on two lines along a width direction Y orthogonal to the circumferential direction X over the sheet passing area and a non-sheet passing area. The lines are arranged at an interval in the circumferential direction X. The lines of the slits 55 are respectively arranged at an interval from both ends of the body part in the circumferential direction X.

Moreover, in the body par 51, a swelling part 57 is formed as a protection part preventing the inner circumferential face of the fixing belt 21 from coming into direct contact with the periphery of the slits 55. The swelling part 57 is formed by drawing other portions than respective elliptic portions 51*a* on the periphery of the slits 55 (called as peripheral portions), both end portions 51*b* in the circumferential direction X of the body part 51 (called as circumferential end portions), and both end portions 51*c* in the width direction Y of the body part 51 (called as width end portions) from the inside (a right side on FIG. 4) the body part 51. As shown in FIG. 3, at one side in the circumferential direction X, the peripheral portions 51*a* of the slits 55 of one line communicate with one circumferential end portion 51*b* and, at the other side in the circumferential direction X, the peripheral portions 51*a* of the slits 55 of the other line communicate with the other circumferential end portion 51*b*. The circumferential end portions 51*b* and the width end portions 51*c* communicate with each other.

As shown in FIG. 4, the swelling part 57 has an even smooth contact face 57*a*. Corners 57*b* (corners between the contact face 57*a* and side faces 57*c*) of the swelling part 57 are arcuately curved. A height of the swelling part 57 is, as one example, 1 mm.

In other words, the slits 55 are formed in non-swelling parts of the body part 51, in which drawing is not applied, other than the swelling part 57.

With reference to FIG. 2, the belt guide 29 is arranged in the hollow part of the fixing belt 21 so that the body part 51 faces to the IH heater 27, and the supporting end parts 53 are fixed to the supporting member 31.

Fixing operation of the fixing device 11 having above-described structure will be described. First, the pressuring roller 23 is driven by the driving source to rotate. Then, the fixing belt 21 pressured by the pressuring roller 23 in the pressuring area N is rotated in a counterclockwise direction on FIG. 2 opposite to a rotation direction of the pressuring roller 23 by following the pressuring roller 23. At this time, the fixing belt 21 is guided along the belt guide 29. After that, the IH heater 27 is driven to generate the magnetic flux, and the fixing belt 21 is heated by the eddy current caused when this magnetic flux is passed through the base material layer of the fixing belt 21. The fixing belt 21 is heated until predetermined control temperature (e.g. 160 degree centigrade) is reached. The fixing belt 21 is rotated while the inner circumferential face of the fixing belt 21 comes into contact with or does not come into contact with the belt guide 29. When the inner circumferential face of the fixing belt 21 comes into contact with the belt guide 29, the inner circumferential face comes into contact with the smooth contact face 57*a* of the swelling part 57 of the body part 51, but does not come into contact with the non-swelling parts. That is, portions on the periphery of the slits 55 do not come into direct contact with the inner circumferential face of the fixing belt 21.

When the sheet S having the transferred toner image is conveyed to the pressuring area N, the sheet S is heated by the fixing belt 21 and pressured by the pressuring roller 23 and the fixing belt 21, and then, the toner image is fixed on the sheet S. The sheet S having the fixed toner image is conveyed from the pressuring area N along the conveying path 17.

As described above, because the thickness of the base material layer of the fixing belt 32 is very thin (in this example, 30 μm), the magnetic flux may penetrate through the base material layer. The magnetic flux after penetrating passes through the belt guide 29, and then, eddy current is caused in the belt guide 29 to generate heat in the belt guide 29. In the belt guide 29, the plurality of slits 55 are formed at regular intervals along the width direction Y. Accordingly, the eddy current is caused between the adjacent slits 55. Therefore, even if temperature of the non-sheet passing area is risen, heat is hardly transmitted to the sheet passing area and changing of the magnetic characteristics in the sheet passing area from ferromagnetism to paramagnetism is restrained.

As explained above, in accordance with the fixing device 11 of the present disclosure, the swelling part 57 prevents the inner circumferential face of the fixing belt 21 from coming into direct contact with the portions on the periphery of the slits 55. In detail, when the fixing belt 21 is guided along the belt guide 29, the inner circumferential face of the fixing belt 21 comes into contact with mainly the swelling part 57, but does not come into direct contact with the slits 55. Therefore, it is possible to restrain the fixing belt 21 from being damaged by an edge of the slit 55 and to maintain durability of the fixing belt 21.

Moreover, since the swelling part 57 has a drawing shape and the corner 57*b* is arcuately curved, the inner circumferential face of the fixing belt 21 is not caught by the corner 57*b* of the swelling part 57, and thereby, it is possible to stably rotate the fixing belt 21 without damaging the fixing belt 21.

Further, since the swelling part 57 is formed with avoiding the circumferential end portions 51*b* and the width end portions 51*c* of the body part 51, the drawing shape for forming the swelling part 57 is easy to carry out.

Figure 5:
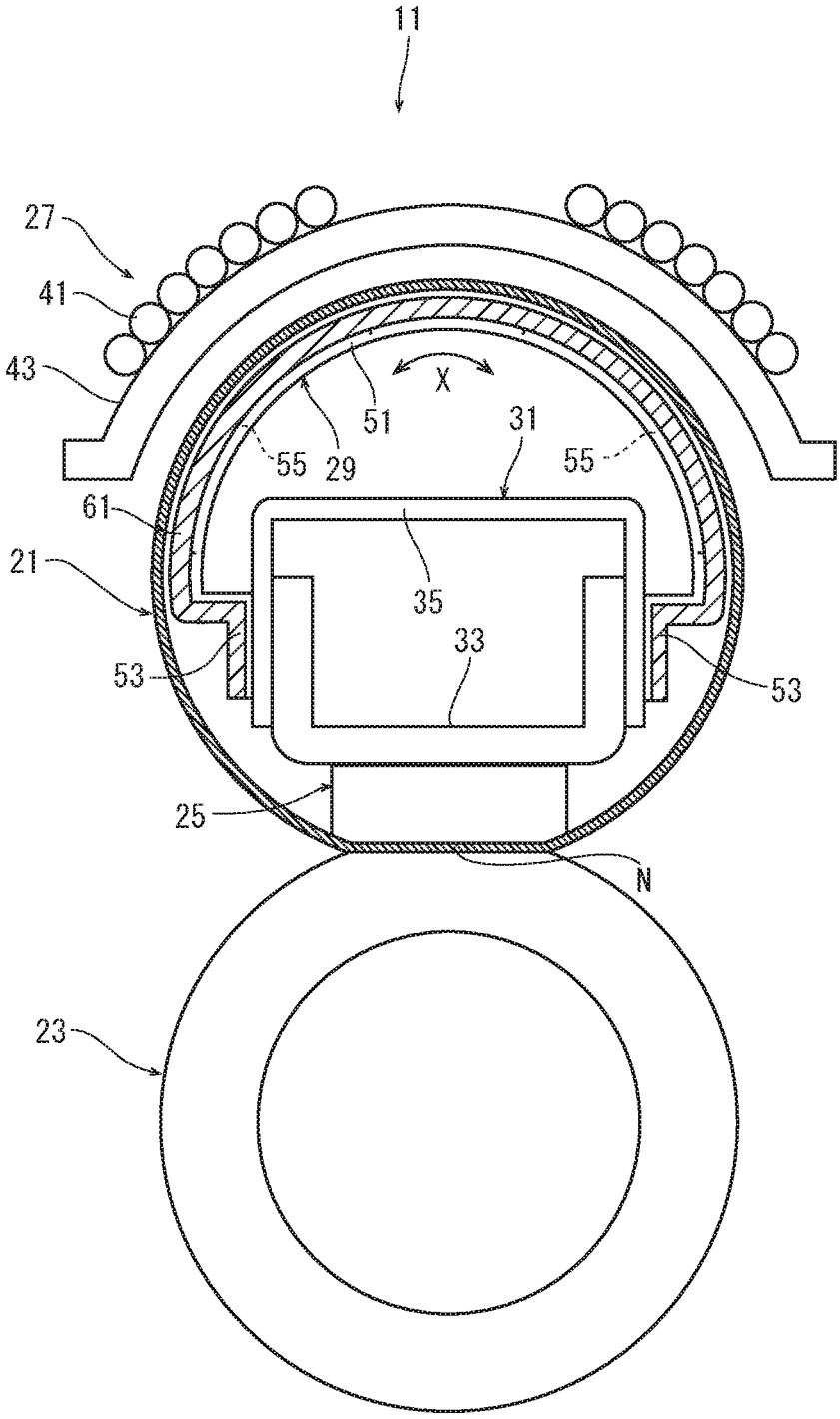
FIG. 5 is a sectional view schematically showing a fixing device according to a second embodiment of the present disclosure.

Next, with reference to FIG. 5, the belt guide 29 according to a second embodiment will be described. FIG. 5 is a sectional view schematically showing the fixing device 11.

In the second embodiment, in the body part 51 of the belt guide 29, the slits 55 similar to the first embodiment are formed, but the swelling part 57 is not formed. On the other hand, a surface (a face facing to the inner circumferential face of the fixing belt 21) of the body part 51 is covered by a protecting member 61 as a protecting part preventing the inner circumferential face of the fixing belt 21 from coming into direct contact with the portions on the periphery of the slits 55. In other words, the protecting member 61 is provided on an outer circumferential face of the belt guide 29. The protecting member 61 is made of non-magnetic material (e.g. polyphenylene sulfide (PPS), polyimide (PI), a liquid crystal polymer (LCP) or the like) having heat resistance against Curie temperature (200 degree centigrade) of the belt guide 29 or against temperature higher than Curie temperature. Both ends in the circumferential direction X of the protecting member 61 are fixed by the supporting end parts 53 of the belt guide 29.

When the fixing belt 21 is rotated by following the pressuring roller 23 during fixing operation, the fixing belt 21 comes into contact with the protecting member 61 and is guided along the protecting member 61. That is, the inner circumferential face of the fixing belt 21 does not come into direct contact with the slits 55 of the belt guide 29.

In the second embodiment, when the fixing belt 21 is guided along the belt guide 29, the slits 55 of the belt guide 29 does not come into direct contact with the inner circumferential face of the fixing belt 21. Therefore, it is possible to restrain the fixing belt 21 from being damaged by an edge of the slit 55 and to maintain durability of the fixing belt 21.

The technical scope of the present disclosure is not limited to above-described aspects unless specifically described to limit the present disclosure.

The invention claimed is:

1. A fixing device comprising:

a flexible endless fixing belt;

a heating part induction-heating the fixing belt from outside; and a belt guide supporting the fixing belt so that the fixing belt faces to the heating part, wherein the belt guide is made of temperature sensitive magnetic material with magnetic characteristics reversibly changing from ferromagnetism to paramagnetism when predetermined temperature is reached, and includes a plurality of slits arranged in a width direction orthogonal to a circumferential direction of the fixing belt and formed along the circumferential direction, the belt guide includes a protecting part, the protecting part is provided at a side of an inner circumference face of the fixing belt so as to prevent the inner circumference face of the fixing belt from coming into direct contact with portions on the periphery of the plurality of slits, the protecting part is a protruding part formed at other portions than portions on the periphery of the plurality of slits, and a corner of the protruding part is arcuately curved.

2. The fixing device according to claim 1, wherein the belt guide includes a body part coming into contact with or coming close to the inner circumferential face of the fixing belt, the protruding part is formed at other portions than both end portions in the circumferential direction of the body part and both end portions in the width direction of the body part.

3. An image forming apparatus comprising:

an image forming part forming a toner image on a sheet; and the fixing device according to claim 2 fixing the toner image on the sheet.

4. The fixing device according to claim 1, wherein the protecting part is a protecting member provided on an outer circumferential face of the belt guide and having heat resistance against temperature higher than the predetermined temperature.

5. An image forming apparatus comprising:

an image forming part forming a toner image on a sheet; and the fixing device according to claim 4 fixing the toner image on the sheet.

6. An image forming apparatus comprising:

an image forming part forming a toner image on a sheet; and the fixing device according to claim 1 fixing the toner image on the sheet.

* * * * *